United States Patent [19]

Ang

[11] Patent Number: 5,022,127

[45] Date of Patent: Jun. 11, 1991

[54] SHOELACE LOCKING DEVICE

[75] Inventor: Joseph Ang, Garden City, N.Y.

[73] Assignee: Hope Industries, Inc., New York, N.Y.

[21] Appl. No.: 448,245

[22] Filed: Dec. 20, 1989

[51] Int. Cl.[5] ..... F16G 11/00

[52] U.S. Cl. ..... 24/712.2; 24/712.3; 24/712.6

[58] Field of Search ..... 24/712.2, 712.3, 712.1, 24/712.6, 712.7, 715.3, 712

[56] References Cited

U.S. PATENT DOCUMENTS

| | | | |
|---|---|---|---|
| 303,549 | 8/1884 | Snyder . | |
| 500,497 | 6/1893 | Hathaway . | |
| 528,464 | 10/1894 | Craig | 24/712.2 |
| 575,412 | 1/1897 | Bloom . | |
| 640,004 | 12/1899 | Larew | 24/712.6 |
| 670,561 | 3/1901 | Hoegemann . | |
| 675,155 | 5/1901 | Heiz | 24/712.2 |
| 819,884 | 5/1906 | Higgins . | |
| 1,190,724 | 7/1916 | Chadwick . | |
| 1,221,656 | 4/1917 | Benson . | |
| 1,315,860 | 9/1919 | Polouboyarenof | 24/712.2 |
| 1,371,637 | 8/1921 | Meredith . | |
| 2,200,895 | 5/1940 | Rio . | |
| 3,066,370 | 12/1962 | Epstein . | |
| 3,114,950 | 12/1963 | Sellman . | |
| 3,122,805 | 3/1964 | Hakim . | |
| 3,176,362 | 4/1965 | Tames . | |
| 3,225,402 | 12/1965 | Altman et al. . | |
| 3,290,745 | 12/1966 | Maxwell et al. . | |
| 3,345,707 | 10/1967 | Rita | 24/712.2 |
| 3,418,733 | 6/1964 | Tyrell et al. . | |
| 3,473,198 | 10/1969 | Meier . | |
| 3,908,238 | 9/1975 | Panicci | 24/712.3 |
| 4,553,293 | 11/1985 | Blum . | |
| 4,715,094 | 12/1987 | Herdman . | |
| 4,805,270 | 2/1989 | Kimbrough . | |

FOREIGN PATENT DOCUMENTS

| | | | |
|---|---|---|---|
| 2004575 | 8/1970 | Fed. Rep. of Germany | 24/712.3 |
| 650180 | 1/1929 | France . | |
| 0013408 | of 1900 | United Kingdom | 24/712.3 |
| 16527 | of 1904 | United Kingdom . | |
| 135431 | 11/1919 | United Kingdom . | |

*Primary Examiner*—Victor N. Sakran

*Attorney, Agent, or Firm*—Laff, Whitesel, Conte & Saret

[57] ABSTRACT

A shoelace locking device has a base with holes through which shoelaces can be threaded to attach it to a shoe. The base has a first well in which the knot can rest, and a plurality of serrated projections for retaining the laces. The base has a flexible elastic sheath integral with an elastic hinge and cover. The cover has a matching second well for receiving part of the knot. An elastic latch on the cover can be pulled over a catch on the base to lock the assembly closed and prevent the knot from untying.

7 Claims, 1 Drawing Sheet

SHOELACE LOCKING DEVICE

BACKGROUND OF THE INVENTION

Numerous devices have been invented to keep ordinary shoelaces on a shoe from untying. One early example is U.S. Pat. No. 819,884, which was designed to secure the laces without having to fully knot them. The laces were merely looped over two ribs on a base to assume the appearance of a typical bow knot, and the hinged cover was then depressed over the laces to hold them in place. Increasingly more elaborate and costly designs were invented in more recent years, as typified by U.S. Pat. Nos. 3,290,745 and 4,805,270. The latter patent additionally provided a character face or design on the outside surface. These patented inventions were clamped down over and concealed the knot from view. However, modern shoelaces, and particularly those on children's shoes, come in a variety of materials, thicknesses and widths. Children frequently interchange shoelaces on the same shoes to coordinate colors with their outfits or moods. Therefore, the devices which clamp down upon and conceal ordinary shoelace knots may not be sufficiently flexible to accommodate the more sizeable shoelace knots of the modern shoelaces.

U.S. Pat. No. 4,553,293 takes a different approach. It discloses a device with a pair of spaced elastic bands which engage the knot on opposing sides and expose it for view. A body portion provides a space for decorative design. But this construction is susceptible to the well-known propensity of elastic bands to break or snap. Also, the exposed knot detracts aesthetically from the decorative design. Thus, there is a need for a device which is relatively simple in construction, sufficiently flexible to accommodate the different knots of modern shoelaces, and reliable to operate.

SUMMARY OF THE INVENTION

Accordingly, the present invention provides an improved device for keeping a shoelace knot from untying and comprises a base with holes through which the shoelaces can be threaded to secure the base to the shoe. The base includes a well or depression bordered on two sides by upwardly extending projections, and on the other sides by upwardly extending ledges. A catch projects outwardly from the base. A cover is attached to the base by a flexible, elastic hinge. The cover also includes a well or depression, positioned so that a shoelace knot can fit within both the cover well and the base well. A flexible, elastic latch extends outwardly from the cover and can be connected to the catch, thereby keeping the cover and base closed over the knot.

BRIEF DESCRIPTION OF THE DRAWINGS

The principles of the invention are shown in the attached drawings, in which.

DESCRIPTION OF THE PREFERRED EMBODIMENT

Figure 1:
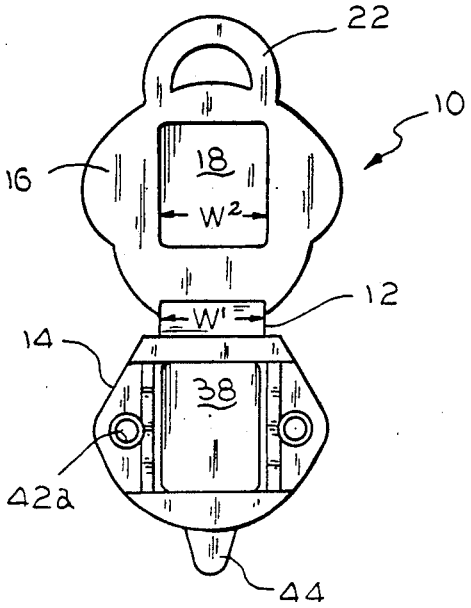
FIG. 1 is a plan view of the invention when the cover is opened.
Figure 2:
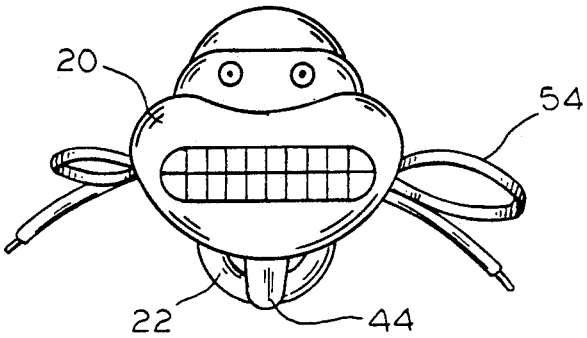
FIG. 2 is a plan view of the invention when the cover is closed over shoelace.

A shoelace locking device according to the present invention is shown in FIGS. 1 and 2. A cover 10 is attached by a hinge 12 to a base 14. The cover has a generally planar interior surface 16, except that a first well 18 is formed in the cover to extend towards, but not completely through to, exterior surface 20 of cover 10. The cover includes a latch 22, shown in the form of a loop, integrally formed with the remainder of the cover. Preferably, the cover is composed of a flexible elastic material, such as polypropylene, upon which a decorative design can be formed.

The hinge 12 is integrally formed with the cover. It is also composed of a flexible, elastic material, preferably polypropylene, and desirably has a width $W^1$ that corresponds to the width $W^2$ of first well 18.

Figure 3:
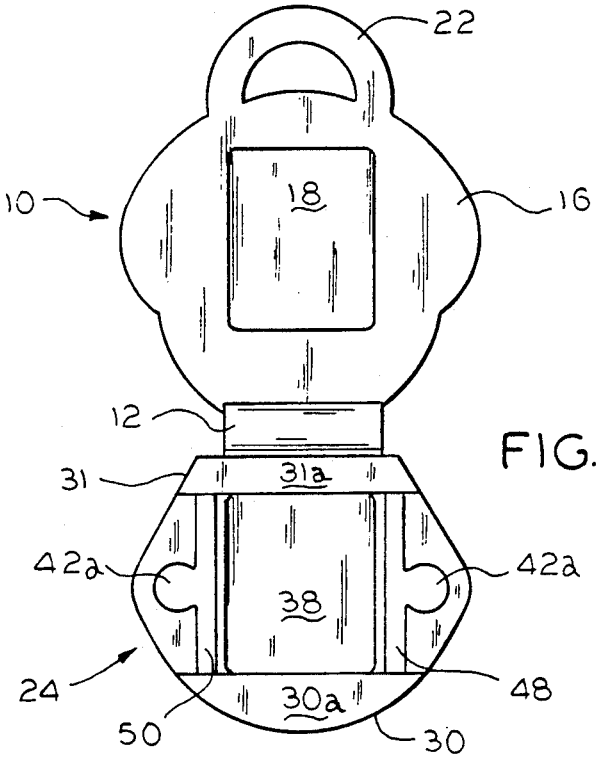
FIG. 3 is a plan view of the cover, hinge, and sheath of the invention.
Figure 4:
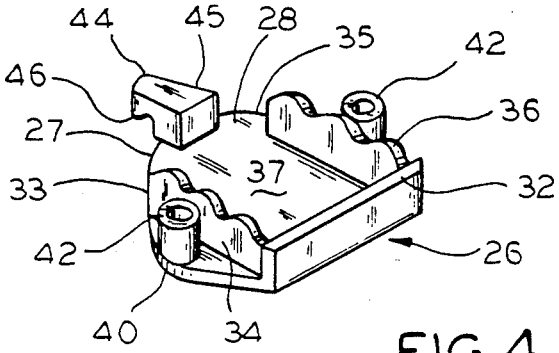
FIG. 4 is a perspective view of the foundation of the invention.

The base 14 is preferably formed of two molded parts 24 and 26, as best shown in FIGS. 3 and 4. FIG. 3 shows the first part 24 integrally formed with hinge 12 and cover 10. The first part 24 is essentially a sheath or jacket for the second part or foundation 26, and sheath 24 conforms generally to the configuration of the foundation. Accordingly, the foundation 26 will be described before the sheath.

The foundation 26 of base 14 is preferably composed of a rigid ABS plastic. A side wall 27 circumscribes foundation 26. The foundation includes ledge 32 which extends upwardly from side wall 27 above interior surface 28. The foundation also includes two spaced rows of teeth or serrated surfaces 34, 36 extending transversely to the longitudinal direction of the ledge, and upwardly from surface 28 a distance which is less than the height of the ledge 32 above surface 28. The rows of teeth 34, 36 and the ledge 32 border a U-shaped area 37 on surface 28. Foundation 26 further includes a pair of apertured cylinders 42, the apertures of which extend through to bottom surface 40. A projection or catch 44 extends outwardly from foundation 26 opposite from ledge 32. The latch includes a hooked end 46 for grasping and retaining latch 22.

Sheath 24 overlays surface 28, ledge 32, side wall 27, and cylinders 42. It further includes a ledge 30 which fits between the ends 33 and 35 of serrated projections 34 and 36, respectively, and abuts the interior end 45 of catch 44. Sheath 24 also has a ledge 31 which covers ledge 32 of foundation 26. Ledge 31 is a thin covering over ledge 32, while ledge 30 extends upwardly from surface 37 to a height equal to the combined heights of ledges 32 and 31. Consequently, ledges 30 and 31 provide coplanar upper resting surfaces **30*a* and 31*a*, respectively, for the cover 10** when it is closed.

The sheath 24 further includes a central depression or second well 38 between ledges 30, 31 over U-shaped area 37. Sheath 24 has a pair of apertures **42*a* coaxial with aperture cylinders 42, and a pair of slots 48, 50 through which the rows of teeth 34, 36 can protrude when sheath 24 is positioned over foundation 26. See FIG. 5. Likewise, an opening (not shown) in the side wall 52 permits catch 44 to extend outwardly from both sheath 24 and foundation 26** when the two parts are assembled.

Figure 5:
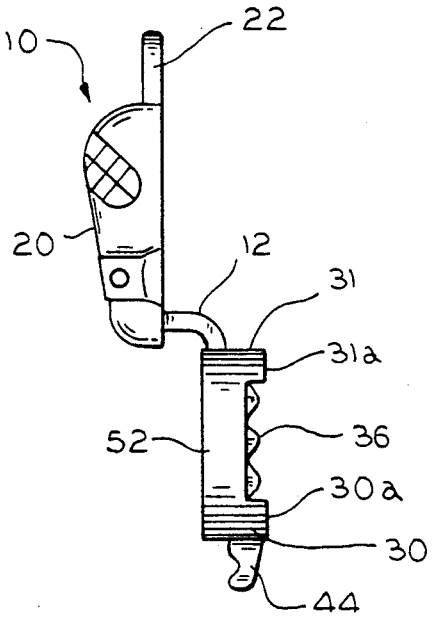
FIG. 5 is a side view of the invention when the cover is opened.

The assembled shoelace locking device is shown in FIGS. 1, 2, and 5. The cover 10, hinge 12 and sheath 24 are integral, so that when the foundation is covered by the sheath, the entire assembly is complete. The sheath is secured to the foundation by inserting the ledge 30 in its proper position and applying a suitable adhesive between the sheath and the foundation. Second well 38 is thus bordered by ledges 30, 31 and serrated projections 34, 36.

To connect the assembly to a shoe, shoelaces 54 are threaded up through apertured cylinders 42 and apertures 42*a*. The laces 54 are crossed and tied in a knot so that the knot rests within well 38, and the laces lie across teeth 34, 36. The cover 10 is then pulled over the knot so that the knot is also positioned within well 18, stretching hinge 12 as necessary to properly position the knot within both wells. The latch 22 is stretched as necessary to engage catch 44, thereby resiliently locking the cover closed over the knot. The combination of the elastic cover, hinge and latch, and the rows of teeth all frictionally retain the knot in place and resist untying. The resting surfaces 30*a*, 31*a* of ledges 30, 31 prop cover 10 up sufficiently so that, even when the cover is down and the device is locked shut, there is sufficient room for an unusually oversized knot. By simply stretching the latch again, it can be disengaged from the catch and the assembly can be opened to untie the knot.

Those who are skilled in the art will readily perceive ways to modify the invention. Therefore, the appended claims are to be construed to cover all equivalent structures which fall within the true scope and spirit of the invention.

I claim:

1. A device for securing a shoelace knot of a shoe, comprising:

a base, said base having means for securing it to said shoelace and upwardly facing means for receiving said knot;

a separable foundation embedded in said base for providing rigidity therefor;

an elastic hinge affixed to said base;

a cover affixed to said hinge for overlapping said base and concealing said knot within said upwardly facing receiving means; and latching means for securing said cover to said base.

2. The device of claim 1 wherein said cover is elastic and is integral with said hinge.

3. A device for preventing the shoelace knot on a tied shoe from untying, comprising:

a first rigid foundation, said foundation having means for securing said foundation to said shoelace, and a catch projecting outwardly from said foundation;

a sheath affixed to said foundation, said sheath having a first well for receiving the lower part of said knot;

an elastic hinge integral with said sheath; and a cover integral with said hinge and said sheath, said cover having a second well in communication with said first well for receiving the upper part of said knot when said cover is closed over said sheath, said cover further having an elastic latch for securing said cover to said catch.

4. The device of claim 3 wherein said foundation has an interior surface circumscribed by a side wall and a first ledge extending upwardly from said side wall.

5. The device of claim 4 wherein said foundation has a plurality of projections extending upwardly from said interior surface and transversely to said first ledge, said projections protruding through openings in said sheath.

6. The device of claim 5 wherein said sheath has a second ledge spaced apart from and extending parallel to said first ledge and above said projections.

7. The device of claim 6 wherein said sheath overlays said interior surface, side wall, and first ledge.

* * * * *